US009289872B1

(12) United States Patent
Altamirano

(10) Patent No.: US 9,289,872 B1
(45) Date of Patent: Mar. 22, 2016

(54) MULTI-WHEEL GRINDER TOOL

(71) Applicant: Silvano Altamirano, Miami, FL (US)

(72) Inventor: Silvano Altamirano, Miami, FL (US)

( * ) Notice: Subject to any disclaimer, the term of this patent is extended or adjusted under 35 U.S.C. 154(b) by 0 days.

(21) Appl. No.: 14/588,677

(22) Filed: Jan. 2, 2015

(51) Int. Cl.

| | |
|---|---|
| ***B24B 23/02*** | (2006.01) |
| ***B24B 55/02*** | (2006.01) |
| ***B24B 9/06*** | (2006.01) |
| ***B24B 27/00*** | (2006.01) |

(52) U.S. Cl.
CPC . *B24B 9/06* (2013.01); *B24B 23/02* (2013.01); *B24B 27/0076* (2013.01); *B24B 55/02* (2013.01)

(58) Field of Classification Search
CPC ..... B24B 9/06; B24B 23/02; B24B 27/0076; B24B 55/02; B24B 55/102; B24B 23/028; B24B 23/005; B24B 41/04; B28D 1/045; B28D 1/047
See application file for complete search history.

(56) References Cited

U.S. PATENT DOCUMENTS

| | | | | |
|---|---|---|---|---|
| 4,412,401 A * | 11/1983 | Fundell | B23D 45/044 266/57 |
| 5,482,026 A * | 1/1996 | Russell | B28D 1/044 125/12 |
| 6,712,061 B1 * | 3/2004 | Kalb | B23D 45/024 125/10 |
| 6,793,566 B2 * | 9/2004 | Owen | B23Q 1/40 451/139 |

* cited by examiner

*Primary Examiner* — Dung Van Nguyen
(74) *Attorney, Agent, or Firm* — Ruben Alcoba, Esq.

(57) ABSTRACT

A multi-wheel grinder tool provides multiple grinding wheels and polishing pads arranged in a single row, and moving along an edge of a stone slab. The tool is effective for increasing the longitudinal surface area for grinding across the edge of a stone slab. The wheels rotatably grind the edge of the slab while simultaneously moving along the longitudinal axis. As the wheels pass along the longitudinal axis, the pad rotatably engage the edge. The edge of the slab is in contact with each pad from all the wheels. A control wheel is powered by a motor via a gear system and a control axle. Outer wheels are in rotatable communication with the control wheel and run counter to each other. By using multiple wheels, grinding is expedited. The wheels have pads with successive grits. A first pad has course grinding grits. A last pad has fine polishing.

20 Claims, 7 Drawing Sheets

MULTI-WHEEL GRINDER TOOL

BACKGROUND

Typically, a grinder tool is used to grind and polish slabs a stone, such as marble and granite, through a rotatable grinding wheel that is covered by a polishing pad. The pad typically has a specific grit for the type of stone being worked on and the desired appearance for the stone. The wheel passes along the surface of the stone to create the desired grinding and/or polishing effect. Ideally, the grinder tool has to be used in the most uniform possible manner for the best polishing and for the longest life of the tool itself. This uniformity required many passes over the same surface area of the stone slab to achieve the desired appearance for the slab.

The inventor knew that grinder machines for polishing marble were available with a single grinder head having a radial grinder wheel and an attached pad. Typically, the grinder wheel rotates about a vertical axis while the grinder tools oscillates about its horizontal axis. The grinder tool generally has a curved working surface and therefore the tool working surface is substantially reduced to a constantly changing line.

The inventor was also aware that it was often necessary to grind the edges of a slab of stone. The edges were grinded to chamfer soft edges, create decorative bevels, or form a mating surface for two or more slabs. Through years of experience, the inventor recognized that there were several different kinds and sizes of stone edger tools that were used in the field. One such edger was used for shaping the edge of a stone countertop. This edger had a housing with an internal electric motor and a bit extending below the surface of the housing. In use, the housing rested on the level counter surface while the motor spins the bit and the user guides the bit along the edge of the counter surface smoothing and shaping the edge of the stone counter.

However, the inventor quickly recognized that the problem with this type of edger is that the internal motor makes it heavy and difficult to transport and maneuver over the counter surface. Further, the weight of the motor of the edger causes friction between the lower surface of the housing and the stone countertop as the device moves across the countertop. The friction can cause scratches in the stone's surface. Another problem with this type of edger is that it is relatively expensive to purchase and maintain because of the many moving parts that comprise the gears and internal motor.

The inventor was also familiar with another edger, often referred to as a stone polisher. The inventor had used a stone polisher before, and knew that stone polishers were essential tool for stone workmen. The inventor had often used a stone polisher in the past. The stone polisher is a small hand tool comprising a rotating shaft and wheel able to combine with various bits for etching, polishing, and cutting slab materials such as stone. Stone polishers were generally powered pneumatically or electrically.

The inventor, though, recognized that the problem with using a stone polisher as an edger is that stone polishers do not have housings or other guides for aligning and squaring them with the stone. This makes it difficult to form consistent cuts and profiles in stone edges because the angle of the stone polisher relative to the stone's edge is hard to keep consistent. This can lead to more time spent by the stone workman, which means more expense to finish the stone product.

The inventor decide to fabricate a grinder tool that was lightweight and had a small motor, so that the tool could be carried to the stone slab, rather than the slab having to be moved. The inventor realized that a smaller grinder tool could be effective in making smaller cuts and profiles, especially on the edge of the slab. However, the tool was still too slow and required multiple passes along the edge of the stone slab.

Through trial and error, the inventor realized that the efficiency and effectiveness of polishing stones depended on the number of the wheels and pads that could be carried by the tool. By adding multiple wheels along the tool, the grinding surface area along the longitudinal axis of the edge of the slab was expanded. The inventor also recognized that powering a single central wheel saved energy.

After further trial and error, the inventor added different pads on each wheel. The inventor knew that the grit on each pad affected the speed of the grinding process. The inventor recognized that diamond grinding cup wheels are used in different-roughness grindings. For coarse grinding, the bond may be softer and the diamonds' quality higher, because in this case the diamonds are more easily to become blunt.

The inventor knew that in this case, the diamond grit should be bigger, normally from 35 grit to 50 grit. For this is coarse grinding and big grit can improve the working efficiency of the tool. However, for fine grinding, i.e., polishing, the bond may be harder and the diamonds' quality lower. The inventor knew that this was because the diamonds can last longer and hard bond can also help the precision of the processing. For polishing, the diamond grit is normally between 80 grit to 120 grit, depending on the grinding requirements.

However, the inventor saw that the pads were overheating. The inventor knew that a coolant, such as water was often used while grinding stone slabs. The inventor decided to add a fluid inlet that carried water from an outside water source to the tool. The fluid inlet included tubing that directed water onto the pads during their rotation. The water prevented overheating of the pads and helped maintain the grinder tool at optimal efficiency during operation.

Stone grinder tools have been used for economically and efficiently polishing marble and granite in the past, yet none with the present characteristics of the present invention. See U.S. Pat. No. 601,668; U.S. Pat. No. 5,454,751; and U.S. Pat. No. 8,436,624.

For the foregoing reasons, there is a need for a system and method for grinding the edges of stone slabs with a multi-wheel grinder tool that is lightweight and maneuverable.

SUMMARY

The present invention describes a multi-wheel grinder tool that provides multiple grinding wheels arranged in a single row, and moving along a longitudinal axis of an edge of a stone slab. The multiple wheels rotatably grind and/or polish the edge of the stone slab while traversing the longitudinal axis of the edge. Generally, the use of multiple wheels 122, 124*a-c* creates a larger longitudinal surface area along the edge of the slab, which expedites the grinding process. The wheels are covered by polishing pads having progressive grits. As the wheels pass along the longitudinal axis, the pad from each wheel rotatably engages the edge of the slab. In this manner, the edge of the stone slab is in simultaneous contact with each pad from all the wheels.

In some embodiments, the tool is sufficiently small and lightweight, so as to be portable. In this manner, the tool can be carried to the much heavier stone slab, rather than hefting the stone slab to the grinder tool. Also, the generally lightweight disposition of the tool enables a user to manipulate and press the wheels against the edge of the slab.

Those skilled in the art will recognize that the alignment of multiple wheels on the tool exponentially increases the surface area along the edge of the stone slab. For example, when the tool uses four wheels, the grinding capacity is increased by 4×. This increased surface area of grinding wheels not only speeds up the grinding process along the edge of the slab, but also allows for more flexibility in the grinding and polishing process by enabling progressive grits to be used on each successive pad. This increase of grinding surface area through the use of multiple wheels expedites the grinding process. Furthermore, the wheels rotate counter to each other so as to further expedite and enhance the grinding process.

In one embodiment, the tool utilizes a control wheel and a plurality of outer wheels that rotate simultaneously to grind on the edge of the stone slab. The wheels are manually pushed along the longitudinal axis of the edge. The grinding and polishing needs of the slab dictate the amount of pressure to apply on the tool for engaging the wheels thereto. The wheels can be pushed along the longitudinal axis in either linear direction along the edge of the slab. The control wheel and the outer wheels generally align perpendicularly to the edge of the slab, whereby a top surface and a bottom surface of the stone slab are substantially disengaged from the wheels and pads.

The tool is unique in that only the control wheel is powered by a motor. The control wheel rotates in a first direction. The plurality of outer wheels are not independently powered like the control wheel. Rather, the outer wheels are in rotatable communication with the control wheel through a plurality of perimeter teeth. In this manner, a portion of the outer wheels rotate in the same first direction of the control wheel, while a portion of the outer wheels rotate counter to the control wheel in a second direction, depending on their arrangement relative to the control wheel. In one embodiment, two outer wheels are arranged on each side of the control wheel. However, in other embodiments, any number of outer wheels can be arranged relative to the control wheel.

Those skilled in the art will recognize that each wheel is covered with a pad. The pads are used in different-roughness grindings, whereby the grit on the pad determines whether the pad is configured to grind or polish the edge of the slab. In some embodiments, the grit on each pad of the wheels may be progressive. However, in other embodiments, all the wheels may have the same grit. Nonetheless, the grit for each pad is adjustable as needed.

In some embodiments, the tool comprises a support platform that positions across a top surface of the stone slab, adjacent to the edge of the slab. The support platform chiefly serves to carry the tool along the slab, so that the wheels can operate along the edge of the slab. The support platform is defined by an engagement surface having a roller housing that pivots in relation to the support platform to enable manipulation of the wheels and maintenance access. The roller housing pivots on at least one hinge. The roller housing contains a plurality of rollers. The rollers are arranged to roll on the top surface of the slab, perpendicularly to the edge of the slab. The support platform is also defined by a handling surface. The handling surface includes a motor and a pair of handles. Each handle may include a power switch for actuating the motor, as needed. The motor is electrically powered and indirectly powers the control wheel through a pulley. The pulley includes a first pulley end that connects to the motor.

The tool also includes a control portion that perpendicularly joins with the support platform. The control portion contains the gears and wheels used for operation. The control portion orients the wheels generally towards the edge of the slab during operation. In some embodiments, the control portion may include a housing having an access panel. The access panel provides access to a cavity in the housing. The cavity contains a second pulley end of the aforementioned pulley; whereby the rotation generated by the motor simultaneously rotates the first pulley end and the second pulley end. The second pulley end couples to a gear system in the cavity of the control portion. In this manner, the motor actuates the pulley, which in turn actuates the gear system.

The gear system is configured to transmit torque generated by the motor to the control wheel. It is significant to note that the motor does not power the plurality of outer wheels. Rather, the outer wheels are in communication with the control wheel through perimeter teeth. In this manner, energy is saved, as the motor only has to directly operate a single wheel—the control wheel—while the outer wheels rotate off the angular momentum of the control wheel.

A control axle extends transversely through the control portion, between the gear system and the control wheel. The control axle transmits the torque from the gear system to the control wheel for rotation. The control axle passes through a control bushing. The control bushing helps maintain the alignment for the control axle, while a control snap ring helps retain the control axle in the gear system. A plurality of outer axles extend between the gear system and the outer wheels. A plurality of outer bushings maintain the alignment for the outer axles, while a plurality of outer snap rings help retain the outer axles in the gear system. The control axle and the outer axles align along the length of the control portion, inside the cavity of the housing. The respective wheels couple to the ends of the axles for operation.

In some embodiments, a fluid inlet positions on the housing of the control portion. The fluid inlet enables passage of a plurality of fluid lines through the control portion. The fluid lines terminate proximally to the wheels. The fluid lines are defined by a source end and a dispensing end. The fluid lines may carry a fluid, such as water, to sections of the control pad and the outer pads for cooling and lubricating the pads during while they are grinding the edge of the slab. In this manner, each pad may directly receive water while in operation. In one embodiment, a top section of each pad receive water from the dispensing end of the fluid lines. The water flows from the upper section of the pad, and seeps between the edge of the slab and a lower section of the pad to provide the cooling and lubrication.

One objective of the present invention is to provide additional surface area for a stone grinder by including multiple heads that simultaneously rotate along the edge of the slab.

Another objective is to reduce energy consumption by only powering a control wheel and enabling a plurality of outer wheels to rotate off the control wheel through perimeter teeth on the gears.

Another objective is to provide progressive grits on the pads so as to grind and polish simultaneously and create a smoother finish.

Yet another objective is to provide a pivoting roller house to enable the wheels to tilt during engagement with the edge of the slab.

Yet another objective is to provide a lightweight grinder tool that can be carried to the slab manually for grinding the edges without having to move the slab.

Yet another objective is to provide a grinder tool that is inexpensive to manufacture and easy to operate.

DRAWINGS

These and other features, aspects, and advantages of the present invention will become better understood with regard to the following description, appended claims, and drawings where:

FIG. 4A shows a close up view of at least one hinge between the roller housing and the support platform, and FIG. 4B shows a bottom perspective of the tool with the roller housing pivoted outwardly;

FIG. 6B shows an exemplary roller housing.

DESCRIPTION

Figure 1:
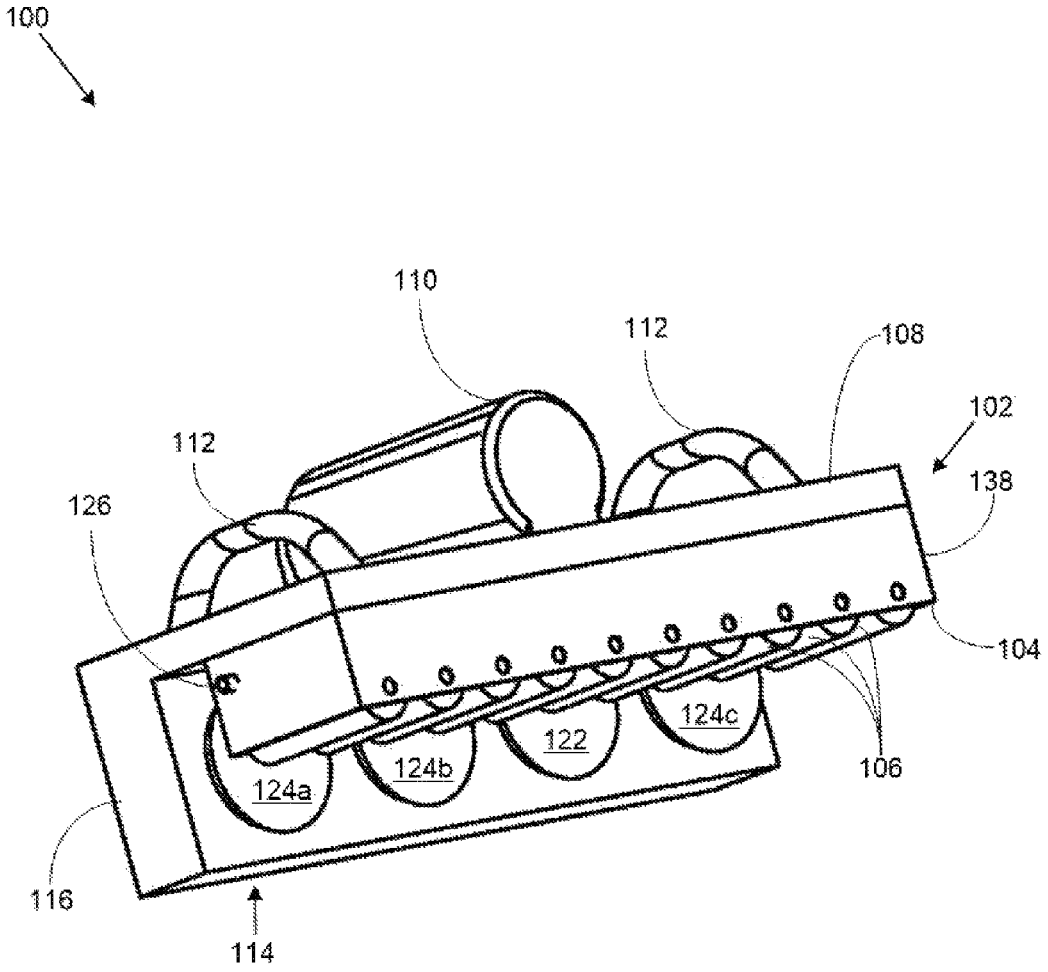
FIG. 1 is a front perspective view of an exemplary multi-wheel grinder tool.

One embodiment, referenced in FIGS. 1-6B, illustrates a multi-wheel grinder tool 100 that provides multiple grinding wheels arranged in a single row, and moving along a longitudinal axis of an edge of a stone slab (not shown). The wheels rotatably grind and/or polish the edge of the stone slab while traversing the longitudinal axis of the edge. The grinding wheels are covered by polishing pads having progressive grits. The tool 100 may be used for grinding and polishing the edges of stone slabs, such as granite and marble. Though, in other embodiments, the tool 100 may be used to grind and polish other types of stone and concrete edges.

The tool 100 operates by simultaneously engaging the edge of the stone slab with a control wheel 122 and a plurality of outer wheels 124*a*, 124*b*, 124*c*. The wheels 122, 124*a-c* rotatably grind and/or polish the edge of the stone slab while moving along the longitudinal axis of the edge of the slab. Generally, the use of multiple wheels 122, 124*a-c* creates a larger longitudinal surface area along the edge of the slab, which expedites the grinding process. The longitudinal axis is generally linear and may follow the long end or the short end of the stone slab. The wheels 122, 124*a-c* rotate counter to each other, so as to further enhance the grinding and polishing effect on the edge of the slab.

In some embodiments, a plurality of interchangeable pads (not shown) cover the wheels 122, 124*a-c* to provide a desired grinding or polishing engagement with the slab. As the wheels 122, 124*a-c* pass along the longitudinal axis, the pad from each wheel 122, 124*a-c* rotatably engages the edge. Each pad may have a progressive grit to enable simultaneous grinding and polishing with the edge of the slab as the tool 100 makes a single longitudinal pass along its edge.

In one embodiment, the tool 100 is manually pushed, pressed, and pivoted along the edge of the slab. In this manner, tactile senses are used to increase or decrease pressure against the edge of the slab for achieving the desired grinding and polishing effect thereto. However, in other embodiments, a series of progressive pressure springs may be used with each wheel 122, 124*a-c*, whereby a spring applies greater pressure for an initial grinding wheel 124*a*, while less pressure is applied by the subsequent polishing wheel 124*c*. In any case, the tool 100 enables the edge of the slab to be in simultaneous contact with each pad from all of the wheels 122, 124*a-c* such as to increase the surface area of the edge being grinded at any one time.

Those skilled in the art will recognize that the alignment of multiple wheels 122, 124*a-c* on the tool 100 exponentially increases the surface area along the edge of the stone slab. For example, when the tool 100 uses five wheels, the grinding capacity is increased by 5×. If the tool 100 uses seven wheels, the grinding capacity would increase by 7×, and so forth. This increased surface area of grinding wheels 122, 124*a-c* not only speeds up the grinding process along the edge of the slab, but also allows for more flexibility in the grinding and polishing process by enabling progressive grits to be used on each successive pad. This increase of grinding surface area through the use of multiple wheels 122, 124*a-c* expedites the grinding process. Furthermore, the wheels 122, 124*a-c* rotate counter to each other so as to further expedite and enhance the grinding process.

As referenced in FIG. 1, the tool 100 utilizes a control wheel 122 and a plurality of outer wheels 124*a-c* that rotate simultaneously to grind on the edge of the stone slab. The wheels 122, 124*a-c* are manually pushed along the longitudinal axis of the edge. The amount of pressure to apply on the tool 100 is dependent on the grinding and polishing requirements of the slab. The wheels 122, 124*a-c* can be pushed along the longitudinal axis in either linear direction along the edge of the slab. The control wheel 122 and the outer wheels 124*a-c* generally align perpendicularly to the edge of the slab, whereby a top surface and a bottom surface of the stone slab are substantially disengaged from the wheels 122, 124*a-c* and the pads.

The tool 100 is unique in that only the control wheel 122 is powered by a motor 110. The control wheel 122 rotates in a first direction. The plurality of outer wheels 124*a-c* are not independently powered like the control wheel 122. Rather, the outer wheels 124*a-c* are in rotatable communication with the control wheel 122 through a plurality of perimeter teeth 148.

In this manner, a portion of the outer wheels 124*a-b* rotate in the same first direction of the control wheel 122, while a portion of the outer wheels 124*c* rotate counter to the control wheel 122 in a second direction, depending on their arrangement relative to the control wheel 122. In one embodiment, two outer wheels are arranged on each side of the control wheel 122. However, in other embodiments, any number of outer wheels can be arranged relative to the control wheel 122.

Those skilled in the art will recognize that each wheel 122, 124*a-c* is covered with a pad. The pads are used in different-roughness grindings, whereby the grit on the pad determines whether the pad is configured to grind or polish the edge of the slab. In some embodiments, the grit on each pad of the wheels 122, 124*a-c* may be progressive. The progressive grits may range from a thirty-five grit to a one hundred-twenty grit, whereby the thirty-five grit is courser for grinding, and the one hundred-twenty grit is finer for polishing. In one possible embodiment, a first outer pad has the thirty-five grit, and a last outer pad has the one hundred-twenty grit. The tool 100 is pushed in the direction where the thirty-five grit engages the edge of the slab first. However, in other embodiments, all the wheels 122, 124*a-c* may have the same grit. Nonetheless, the grit for each pad is adjustable as needed.

Those skilled in the art will recognize that the control wheel 122 and the plurality of outer wheels 124*a-c* may include a diamond grinding cup wheel. The diamond grinding cup wheel is a metal-bonded diamond tool with diamond segments welded or cold-pressed on a steel wheel body, which usually looks like a cup. Diamond grinding cup wheels are usually mounted on stone grinders to grind abrasive building materials like concrete, granite, and marble.

Furthermore, diamond grinding cup wheels are used in different-roughness grindings. For coarse grinding, the bond may be softer and the diamonds' quality higher, because in this case the diamonds are more easily to become blunt. The diamond grit should be bigger, normally from thirty five grit to fifty grit. For this is coarse grinding and big grit can improve the working efficiency of the tool 100. However, for fine grinding, i.e., polishing, the bond may be harder and the diamonds' quality lower. This is because the diamonds can last longer and hard bond can also help the precision of the processing. For polishing, the diamond grit is normally between eighty grit to one hundred-twenty grit, depending on the grinding requirements.

In some embodiments, the tool 100 may sufficiently small and lightweight, so as to be portable. In this manner, the tool 100 can be carried to the much heavier stone slab, rather than hefting the stone slab to the grinder tool 100. Also, the generally lightweight disposition of the tool 100 enables a user to manipulate and press the wheels 122, 124*a-c* against the edge of the slab.

In one embodiment, the control wheel 122 and the outer wheels 124*a-c* each have a 4" diameter. This enables the tool 100 to be about 15-20" in width. Furthermore, the internal components of the tool 100 include a small motor 110 and a simple gear mechanism that does not add significant weight to the tool 100, and thus enables portability to the stone slab.

Figure 2A:
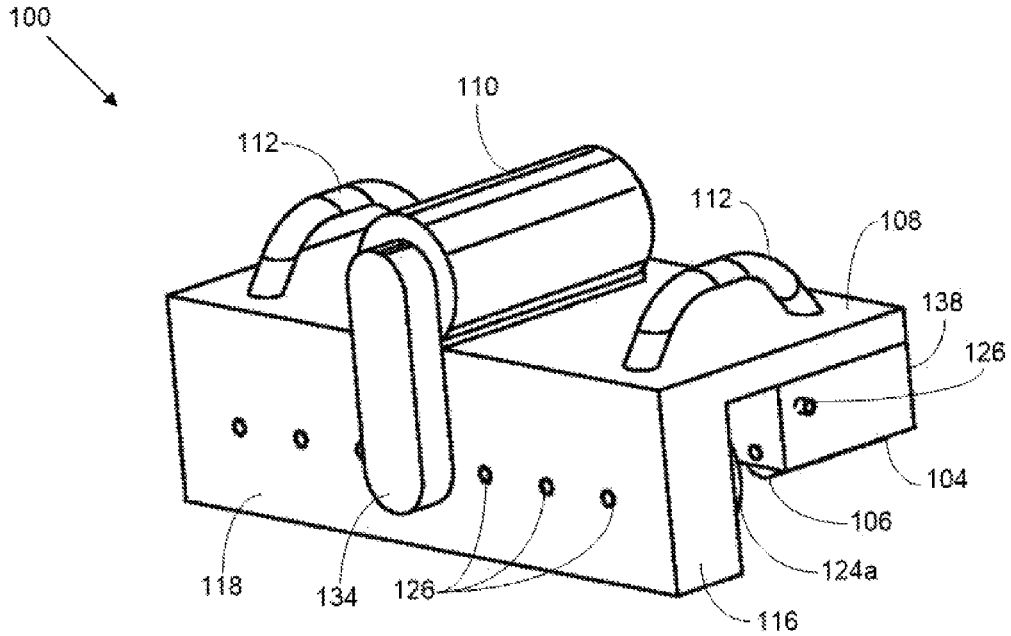
FIGS. 2A and 2B are rear perspective views of an exemplary multi-wheel grinder tool, with FIG. 2A showing an exemplary pulley housing covering an exemplary pulley, and FIG. 2B showing the pulley housing removed to show an exemplary first pulley end and second pulley end.

Turning now to FIG. 2A, the tool 100 comprises a support platform 102 that positions across a top surface of the stone slab, adjacent to the edge of the slab. The support platform 102 chiefly serves to carry the tool 100 along the slab, so that the wheels 122, 124*a-c* can operate along the edge of the slab. The support platform 102 comprises a roller housing 138, having an engagement surface 104 on which the support platform 102 moves.

Figure 2B:
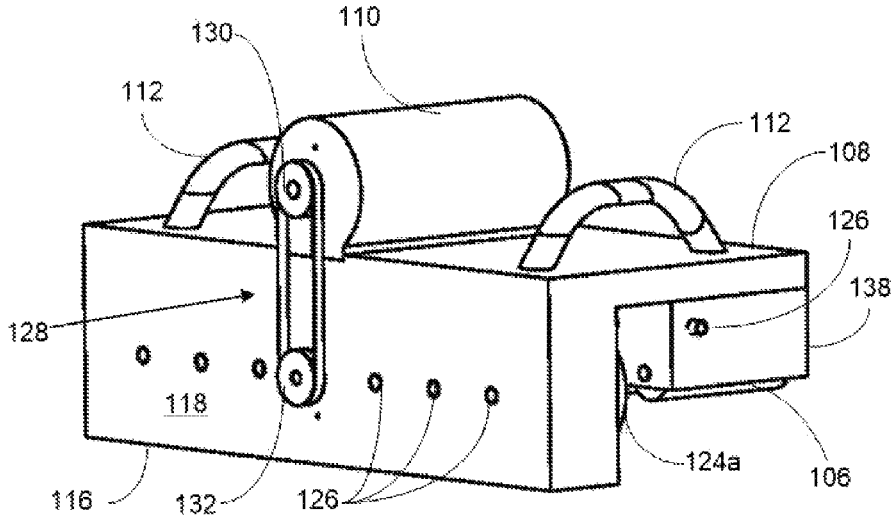
Figure 3A:
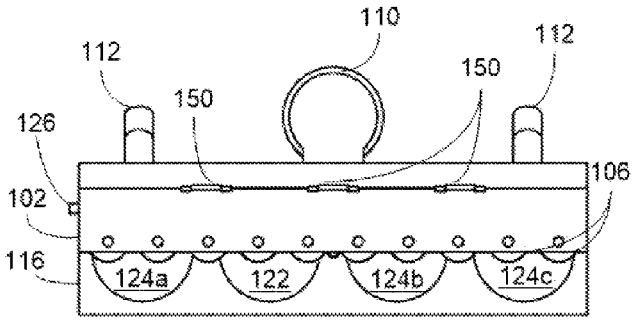
FIGS. 3A and 3B are side views of the multi-wheel grinder tool with an exemplary roller housing in an operational position.

As referenced in FIG. 2B, the engagement surface 104 of the roller housing 138 has an opening through which a plurality of rollers 106 are exposed. The rollers 106 are arranged to roll on the top surface of the slab, perpendicularly to the edge of the slab. The rollers 106 shown in FIG. 3A are aluminum cylinders encased in rubber ridged cylinders. Each aluminum cylinder rotates on a roller axis. The outer rubber surface prevents scratching on the marble. However, in other embodiments, the rollers 106 may include any mechanism that enables a smooth longitudinal movement of the support platform 102 on the top surface of the slab.

Figure 3B:
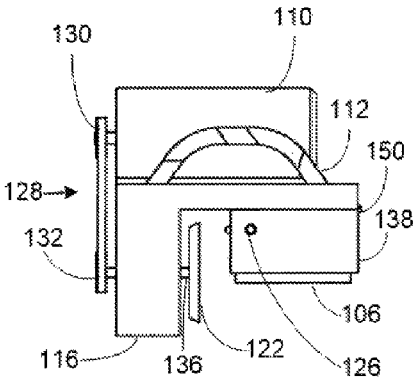
Figure 4A:
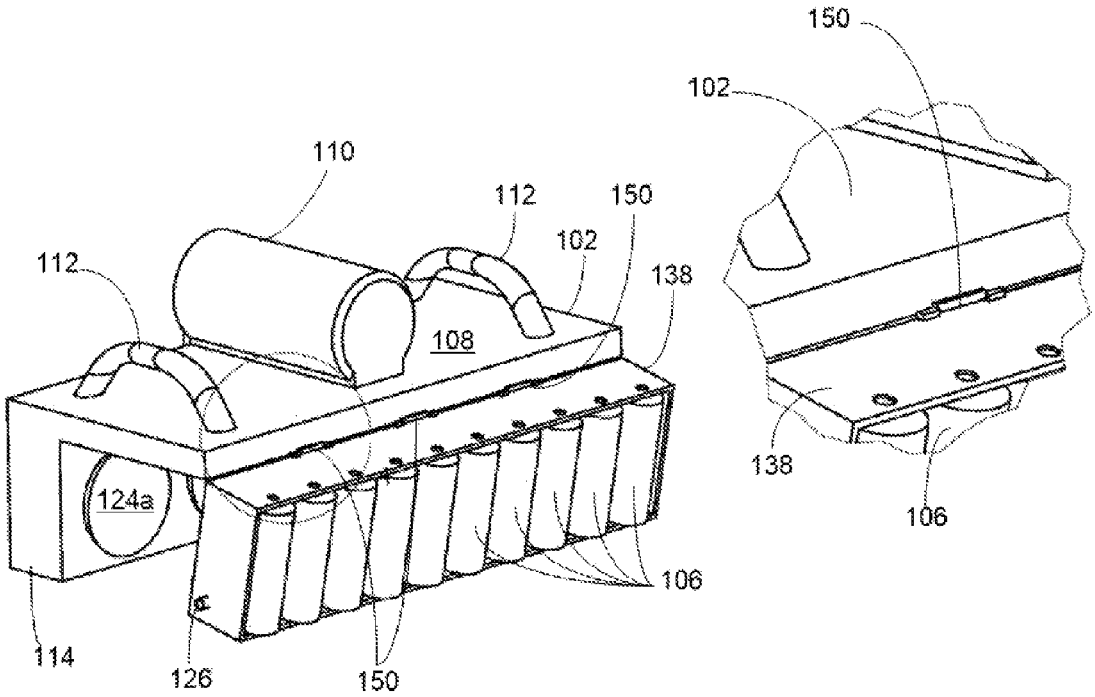
FIGS. 4A and 4B are side views of the multi-wheel grinder tool with the roller housing pivoting to enable various manipulations of the wheels, where
Figure 4B:
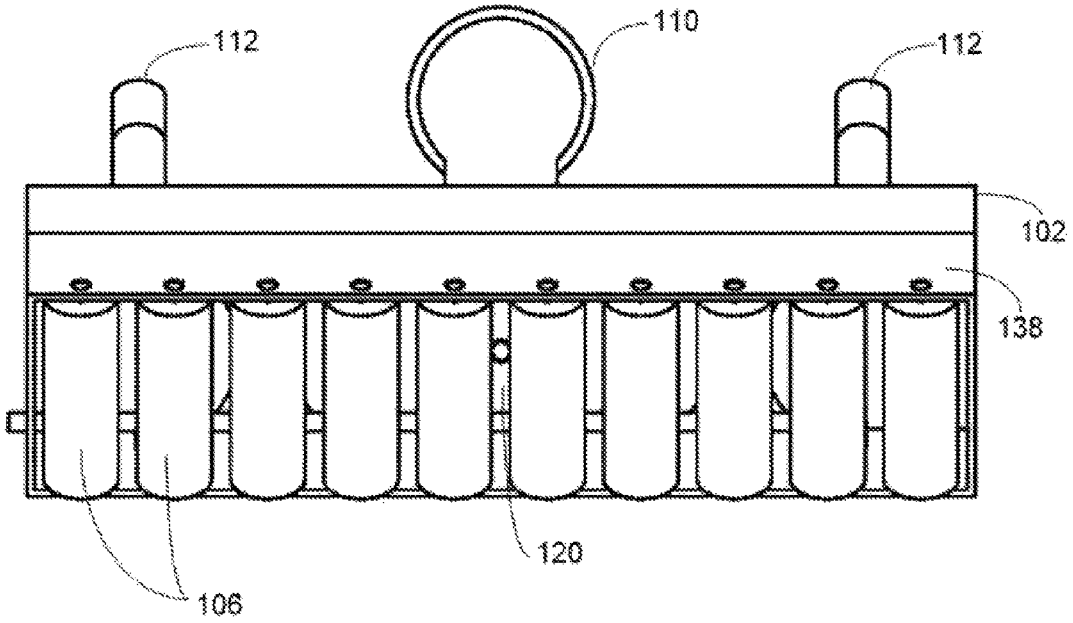

FIG. 3B illustrates the roller housing 138 in an operational position relative to the support platform 102. From this position, the rollers 106 carry the tool 100 across the edge of the slab. However, FIGS. 4A and 4B illustrate the roller housing 138 pivoting away from the support platform 102. In one embodiment, the roller housing 138 pivots on at least one hinge 150. Any type of hinge 150 known in the art may be used, including, without limitation, a pivot hinge, a barrel hinge, a floating hinge, and a butterfly hinge. The pivoting motion of the roller housing 138 creates lateral space for the tool 100 as the wheels 122, 124*a-c* engage the edge of the slab. For example, the wheels 122, 124*a-c* can be pivoted up or down while grinding along the edge of the slab to create a bevel on the edge. This capacity to tilt, rotate, and move the wheels 122, 124*a-c* horizontally and vertically by pivoting the roller housing 138 out of the way may especially be useful since the tool 100 is manual and lightweight. The pivoting motion of the roller housing 138 also provides access to the cavity 120 inside a housing 116 of a control portion 114 for maintenance purposes.

The support platform 102 is also defined by a handling surface 108. The handling surface 108 includes a motor 110 and a pair of handles 112. Each handle 112 may include a power switch (not shown) for actuating the motor 110, as needed. The motor 110 indirectly powers the control wheel 122 through a pulley 128. The motor 110 may include a small electrical motor having a power outlet cable. Though in other embodiments, the motor 110 may be powered by a battery. As discussed above, the motor 110 rotates a pulley 128. The pulley 128 includes a first pulley end 130 that connects to the motor 110. A pulley housing 134 provides a protective cover for components of the pulley 128, such as belts, grooved rollers 106, and tensioners.

Looking back at FIG. 2B, the tool 100 also includes a control portion 114 that perpendicularly joins with the support platform 102. The control portion 114 contains a gear system 140 for operation of the wheels 122, 124*a-c*. The control portion 114 securely holds the wheels 122, 124*a-c* into position, orienting the wheels generally towards the edge of the slab during operation. In some embodiments, the control portion 114 may include a housing 116 defined by a cavity 120 and an access panel 118. The access panel 118 provides access to the cavity 120. The cavity 120 contains a second pulley end 132 of the aforementioned pulley 128; whereby the rotation generated by the motor 110 simultaneously rotates the first pulley end 130 and the second pulley end 132. The second pulley end 132 couples to a gear system 140 in the cavity 120 of the control portion 114. In this manner, the motor 110 actuates the pulley 128, which in turn actuates the gear system 140.

Figure 5:
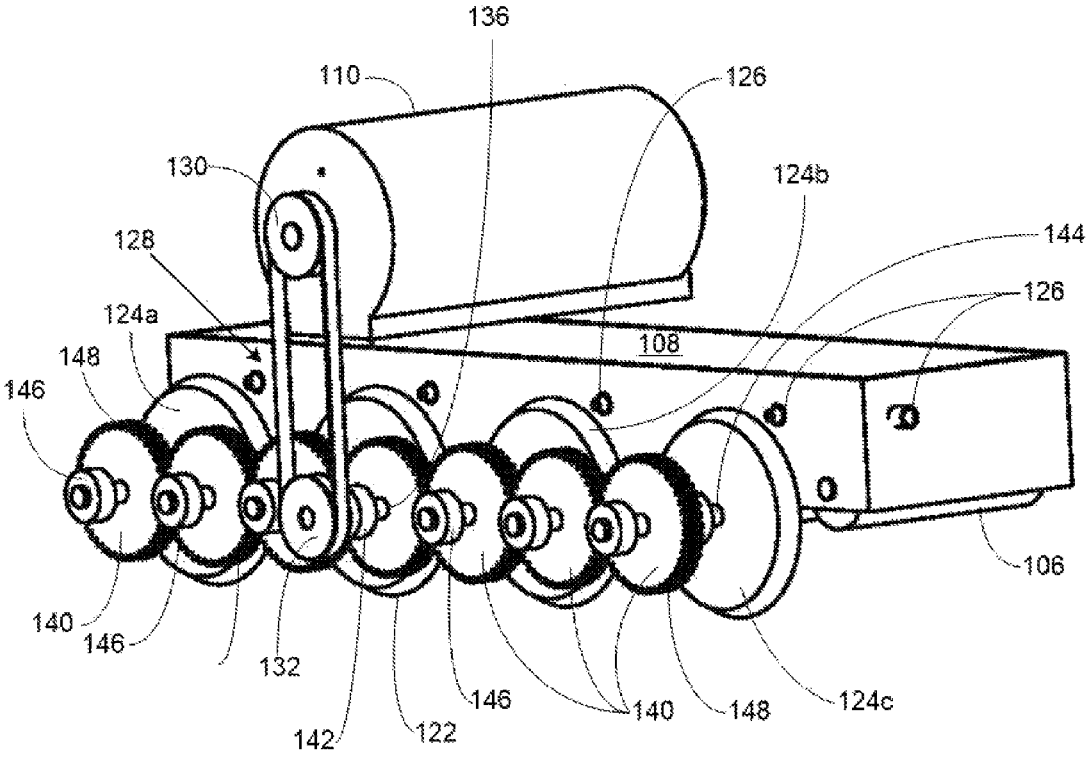
FIG. 5 is a rear perspective view of the multi-wheel grinder tool without the housing, showing an exemplary gear system and axles.

As referenced in FIG. 5, the gear system 140 is configured to transmit torque generated by the motor 110 to the control wheel 122. It is significant to note that the motor 110 does not power the plurality of outer wheels 124*a-c*. Rather, the outer wheels 124*a-c* are in communication with the control wheel 122 through perimeter teeth 148. In this manner, energy is saved, as the motor 110 only has to directly operate a single wheel—the control wheel 122—while the outer wheels 124*a-c* rotate off the angular momentum generated by the control wheel 122.

Figure 6A:
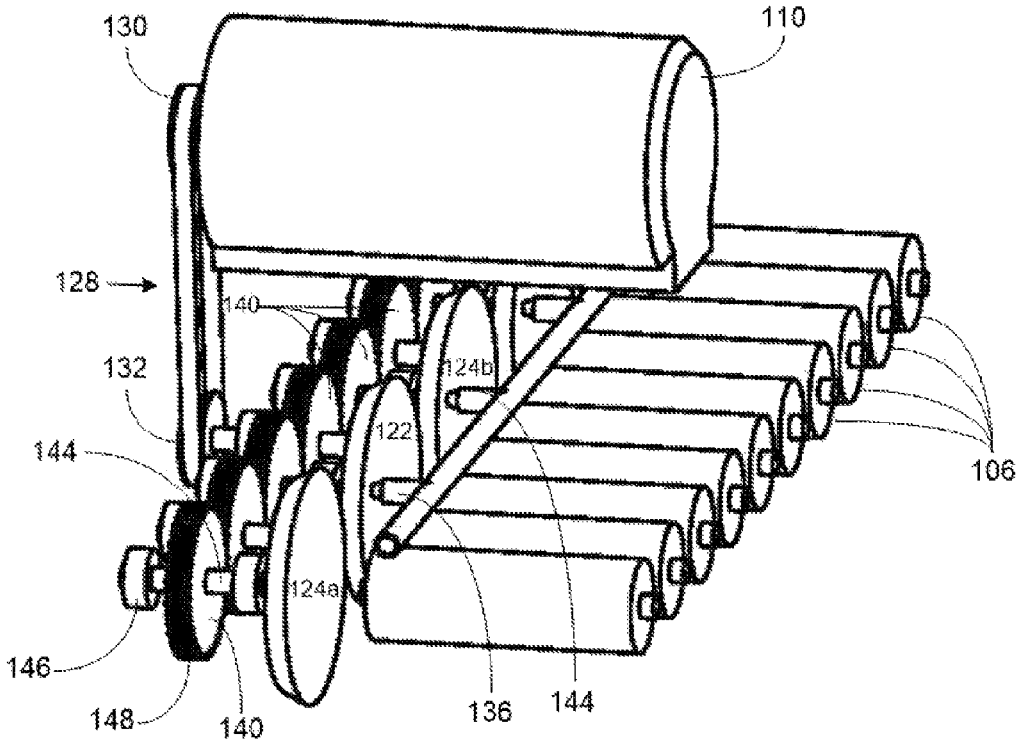
FIGS. 6A and 6B are front perspective views of the multi-wheel grinder tool without the housing, where FIG. 6A show an exemplary control wheel, and outer wheels.
Figure 6B:
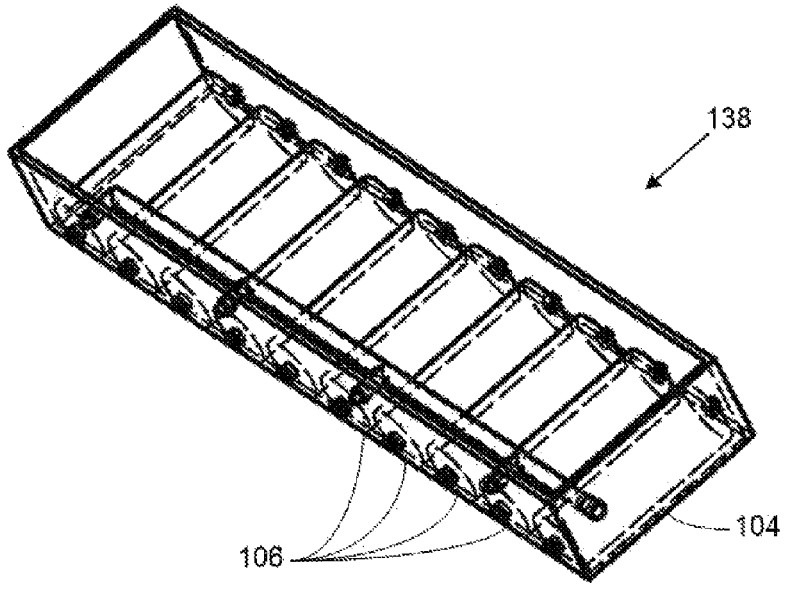

As illustrated in FIG. 6A, a control axle 136 extends transversely through the control portion 114, between the gear system 140 and the control wheel 122. The control axle 136 transmits the torque from the gear system 140 to the control wheel 122 for rotation. The control axle 136 passes through a control bushing 142. The control bushing 142 helps maintain the alignment for the control axle 136, while a control snap ring (not shown) helps retain the control axle 136 in the gear system 140.

A plurality of outer axles 144 extend between the gear system 140 and the outer wheels 124*a-c*. A plurality of outer bushings 146 maintain the alignment for the outer axles 144, while a plurality of outer snap rings (not shown) help retain the outer axles 144 in the gear system 140. The control axle 136 and the outer axles 144 align along the length of the control portion 114, inside the cavity 120 of the housing 116. The respective wheels 122, 124*a-c* couple to the ends of the axles 136, 144 for operation.

In some embodiments, at least one fluid inlet 126 positions on the access panel 118 and sidewalls of the housing 116 in the control portion 114. The fluid inlet 126 enables passage of a plurality of fluid lines (not shown) through the control portion 114. The fluid lines terminate proximally to the wheels 122, 124*a-c*. The fluid lines may include rubber hoses that pass through the cavity 120 of the housing 116. The fluid lines are defined by a source end and a dispensing end. The source end may be connected to a water line or a pump on the control portion 114. The dispensing end may include an adjustable nozzle. The fluid lines may carry a fluid, such as water, to sections of the control pad and the outer pads for cooling and lubricating the pads during while they are grinding the edge of the slab. In this manner, each pad may directly receive water while in operation.

In one embodiment, a top section of each pad receive water from the dispensing end of the fluid lines. The water flows from the upper section of the pad, and seeps between the edge of the slab and a lower section of the pad to provide the cooling and lubrication. The roller housing 116, shown in FIG. 6B, helps maintains a smooth movement of the tool 100 along the edge of the slab, such that the water engages the pads and the wheels 122, 124*a-c*.

While the inventor's above description contains many specificities, these should not be construed as limitations on the scope, but rather as an exemplification of several preferred embodiments thereof. Many other variations are possible. For example, the voltage or current input/output of the motor 110 may vary without affecting the rotation of the control wheel 122. Accordingly, the scope should be determined not by the embodiments illustrated, but by the appended claims and their legal equivalents.

What is claimed is:

1. A multi-wheel grinder tool for increasing the longitudinal surface area for grinding across the edge of a stone slab, the tool comprising:

a support platform defined by a handling surface and an engagement surface, the engagement surface having a plurality of rollers;

a motor disposed to join with the handling surface of the support platform;

a control portion defined by a housing having a cavity, the control portion disposed to join with the support platform at a generally perpendicular orientation;

a gear system disposed in the cavity of the housing;

a pulley arranged to operatively connect the motor to the gear system;

a control wheel arranged to operatively connect to the gear system through a control axle, the control wheel having a control pad, wherein the motor powers rotation of the control wheel in a first direction; and a plurality of outer wheels arranged in rotatable communication with the control wheel through a plurality of perimeter teeth, wherein the control wheel rotates in the first direction, causing a portion of the outer wheels to rotate in the first direction, while a portion of the outer wheels rotate in a second direction, the plurality of outer wheels having a plurality of outer pads, wherein the control pad and the plurality of outer pads are defined by progressive grits.

2. The tool of claim 1, wherein the tool grinds and/or polishes an edge of a stone slab.

3. The tool of claim 2, wherein the tool is manually pushed along a longitudinal axis of the edge of the stone slab.

4. The tool of claim 3, wherein the stone slab is granite or marble.

5. The tool of claim 4, wherein the engagement surface of the support platform engages a top surface of the stone slab.

6. The tool of claim 1, wherein the plurality of rollers are arranged in a roller housing.

7. The tool of claim 6, further including at least one hinge disposed between the roller housing and the support platform, the at least one hinge configured to enable the roller housing to pivot relative to the support platform.

8. The tool of claim 1, wherein the handling surface include a pair of handles having a power switch.

9. The tool of claim 1, wherein the pulley is defined by a cable and a pair of grooved wheels that rotatably receive the cable.

10. The tool of claim 1, wherein the control axle passes through a control bushing and a control snap ring.

11. The tool of claim 1, wherein the plurality of outer wheels are disposed in linear alignment with the control wheel.

12. The tool of claim 1, wherein the control wheel and the plurality of outer wheels are each about four inches in diameter.

13. The tool of claim 1, wherein the plurality of outer wheels are arranged to operatively connect to the gear system through a plurality of outer axles.

14. The tool of claim 13, wherein the plurality of outer axles pass through a plurality of outer bushings and a plurality of outer snap rings.

15. The tool of claim 1, wherein the progressive grits range from a 35 grit to a 120 grit.

16. The tool of claim 15, wherein a first outer pad has the 35 grit, and a last outer pad has the 120 grit.

17. The tool of claim 1, further including at least one fluid inlet defined by a plurality of fluid lines defined by a source end and a dispensing end, the plurality of fluid lines disposed to pass through the control portion, the plurality of fluid lines oriented to discharge water on a top section of the control pad and a top section of the plurality of outer pads.

18. A multi-wheel grinder tool for increasing the longitudinal surface area for grinding across the edge of a stone slab, the tool comprising:

a support platform defined by a handling surface and an engagement surface, the engagement surface having a plurality of rollers;

a motor disposed to join with the handling surface of the support platform;

a control portion defined by a housing having a cavity, the control portion disposed to join with the support platform at a generally perpendicular orientation;

a gear system disposed in the cavity of the housing;

a pulley arranged to operatively connect the motor to the gear system;

a control wheel arranged to operatively connect to the gear system through a control axle, the control wheel having a control pad, wherein the motor powers rotation of the control wheel in a first direction; and a plurality of outer wheels arranged in rotatable communication with the control wheel through a plurality of perimeter teeth, wherein the control wheel rotates in the first direction, causing a portion of the outer wheels to rotate in the first direction, while a portion of the outer wheels rotate in a second direction, the plurality of outer wheels having a plurality of outer pads, wherein the control pad and the plurality of outer pads are defined by substantially the same grit.

19. A multi-wheel grinder tool for increasing the longitudinal surface area for grinding across the edge of a stone slab, the tool comprising:

a support platform defined by a handling surface and an engagement surface, the engagement surface having a plurality of rollers;

a motor disposed to join with the handling surface of the support platform;

a control portion defined by a housing having a cavity, the control portion disposed to join with the support platform at a generally perpendicular orientation;

a gear system disposed in the cavity of the housing;

a pulley arranged to operatively connect the motor to the gear system;

a control wheel arranged to operatively connect to the gear system through a control axle, the control wheel having a control pad, wherein the motor powers rotation of the control wheel in a first direction;

a plurality of outer wheels arranged in rotatable communication with the control wheel through a plurality of perimeter teeth, wherein the control wheel rotates in the first direction, causing a portion of the outer wheels to rotate in the first direction, while a portion of the outer wheels rotate in a second direction, the plurality of outer wheels having a plurality of outer pads, wherein the control pad and the plurality of outer pads are defined by progressive grits; and at least one fluid inlet defined by a plurality of fluid lines defined by a source end and a dispensing end, the plurality of fluid lines disposed to pass through the control portion.

20. The tool of claim 19, wherein the plurality of fluid lines are oriented to discharge water on a top section of the control pad and a top section of the plurality of outer pads.

* * * * *